United States Patent [19]

Holmes

[11] Patent Number: 4,809,331

[45] Date of Patent: Feb. 28, 1989

[54] APPARATUS AND METHODS FOR SPEECH ANALYSIS

[75] Inventor: John N. Holmes, Uxbridge, England

[73] Assignee: National Research Development Corporation, London, England

[21] Appl. No.: 927,721

[22] Filed: Nov. 7, 1986

[30] Foreign Application Priority Data

Nov. 12, 1985 [GB] United Kingdom ..... 8527899

[51] Int. Cl.[4] ..... G10L 5/00

[52] U.S. Cl. ..... 381/41; 381/36; 381/45; 364/513.5

[58] Field of Search ..... 381/31–33, 381/41–50, 29–30, 36–40, 51; 364/513.5, 724; 333/165–167; 370/70, 123; 375/26, 34

[56] References Cited

U.S. PATENT DOCUMENTS

| | | | |
|---|---|---|---|
| 4,389,540 | 6/1983 | Nakamura et al. | 381/41 |
| 4,464,782 | 8/1984 | Beraud et al. | 381/31 |
| 4,538,234 | 8/1985 | Honda et al. | 381/31 X |
| 4,574,392 | 3/1986 | Reiss | 381/51 |
| 4,622,680 | 11/1986 | Zinser | 381/31 X |

*Primary Examiner*—Peter S. Wong
*Assistant Examiner*—Emanuel Todd Voeltz
*Attorney, Agent, or Firm*—Cushman, Darby & Cushman

[57] ABSTRACT

Input signals representative of speech are unreliable as inputs for speech recognition if processed conventionally by, among other processes, filtering into separate frequency bands. Further processing according to the invention takes the output from a filter bank and after operations of rectification and integration provides a process of median filtering and smoothing which significantly reduces the sampling rate of the filtered signals while retaining the important acoustic features of the input speech.

8 Claims, 2 Drawing Sheets

APPARATUS AND METHODS FOR SPEECH ANALYSIS

The present invention relates to methods and apparatus for speech analysis in which a plurality of outputs are provided which are representative of power intensities in a number of channels spread across the audio spectrum. The invention is particularly, but not exclusively, useful in processing speech signals preparatory to speech recognition.

It is well known in speech recognition to convert speech input into digital samples at the Nyquist rate and to filter these samples to provide outputs in a plurality of bands spread across the audio spectrum but in practice this initial processing has been found to be insufficient as a way of generating digital signals representative of intensities in channels corresponding to the filter outputs.

According to a first aspect of the present invention there is provided apparatus for speech analysis comprising an analogue to digital converter, filter means coupled to the output of the converter for providing signals representative of power intensities in a plurality of frequency ranges in the audio frequency band, median-filtering means for repeatedly processing a group of successive samples in each range by multiplying the samples in each group by respective coefficients and summing the resultants, and smoothing means for repeatedly processing a group of successive outputs of the median-filtering means in each range by selecting one output according to relative magnitudes.

An advantage of the invention is that the sampling rate of the filtered signals is significantly reduced while retaining the important acoustic features of input speech.

The selected output of the median-filtering means is preferably that output of maximum magnitude.

The output from the smoothing means in each frequency range is preferably supplied by way of means for computing a corresponding logarithmic value to means for computing a feature vector which has one element representative of the average power over the whole spectrum and a number of further elements equal to the number of frequency ranges, each further element being representative of the power in a respective channel less the average power as computed for the said one element.

Before application to the median-filtering means it is preferable that each filter means output signal is full wave rectified and integrated between time limits.

According to a second aspect of the present invention there is provided a method of spectrum analysis comprising the steps of converting an analogue signal having a spectrum to be investigated to digital form, filtering the digital signals to provide signals representative of power intensities in a plurality of frequency ranges in the said spectrum, repeatedly processing a group of successive samples in each range by multiplying the samples in each group by a respective coefficient and summing the resultants, and repeatedly processing a group of successive summed resultants in each range by selecting one output according to relative magnitudes.

Certain embodiments of the invention are now described by way of example with reference to the accompanying drawings, in which.

Figure 1:
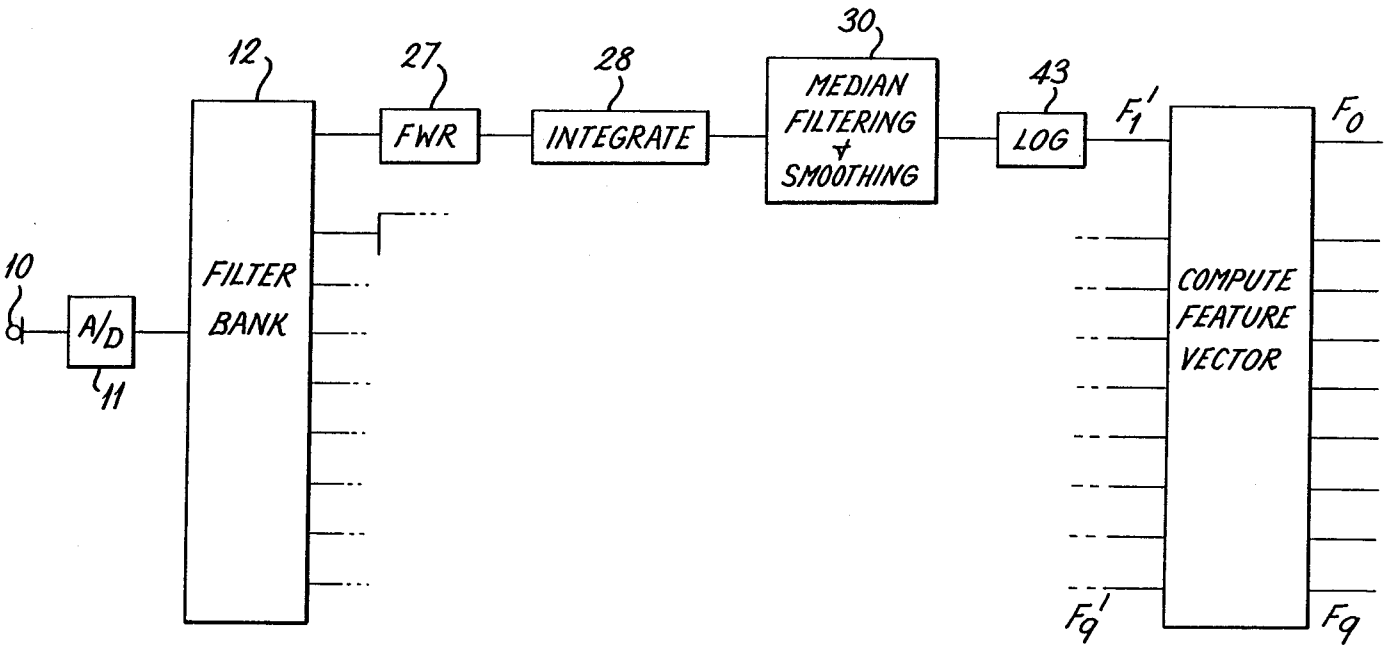
FIG. 1 is a block diagram for apparatus according to the invention.

In the acoustic analyser of FIG. 1 speech input is received by a microphone 10 and passed to an analogue to digital converter 11 which also includes amplification and dynamic processing to reduce the dynamic range of the input signals. Typically the A/D converter 11 generates digital samples at 10 kHz which are applied to a filter bank 12 having nine output channels each covering a different part of the audio frequency spectrum from 0 to 4.8 kHz for example. The frequency ranges of channels may for example have equal bandwidths up to about 1 kHz, to give four channels each of bandwidth 250 kHz, and logarithmically increasing bandwidths between 1 kHz and 4.8 kHz.

The description which follows uses functional blocks which can be put into effect either as hardware circuits or as computer operations. For example the filter bank and the other operations shown in FIG. 1 may be carried out by a signal processing integrated circuit such as a TMS-320 available from Texas Instruments or a special purpose integrated circuit may be used. The circuit may be made, for example, by customising a gate array or by using discrete integrated circuits.

Figure 2:
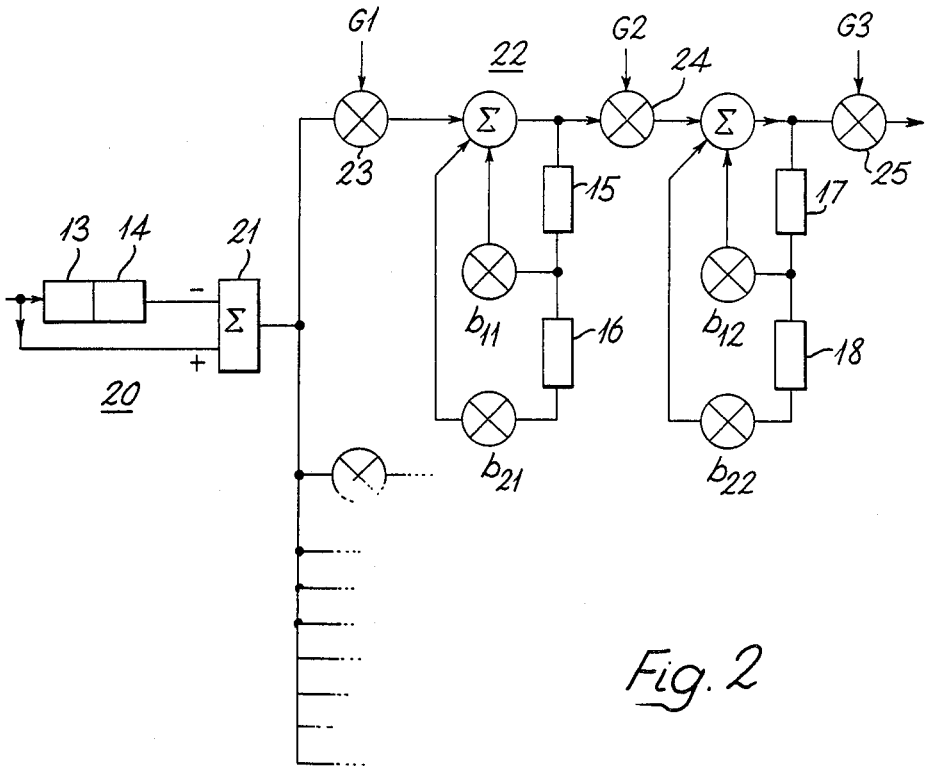
FIG. 2 is a block diagram of the filtering processes carried out by the filter bank of FIG. 1.

The filter bank 12 may, for instance, be constructed as shown in FIG. 2 where each of blocks 13 to 18 represents a one sample period. Signals from the A/D converter 11 are first applied to an all zero filter 20 which comprises the two delays 13 and 14 and a summing operation 21 in which samples delayed by two sample periods are subtracted from the current sample. The function of the zero filter 20 is to remove any d.c. component and to attenuate any component at half the sampling frequency. The output of the all zero filter is applied to nine channels whose outputs are, when the TMS-320 is used, calculated in turn. One of the channels 22 is shown in detail and comprises three multipliers 23 to 25 with gains of G1, G2 and G3 which have the function of ensuring that the correct signal level is maintained, that is that overflow does not occur. Each channel comprises two iterations in which the current sample is added to previous samples delayed by one and two sample periods. In the first stage each delayed sample is also multiplied by coefficients $b_{11}$ and $b_{21}$, respectively before addition and in the second stage coefficients $b_{12}$ and $b_{22}$ are used. The way in which the coefficients $b_{11}$ to $b_{22}$ and similar coefficients for the other eight channels are derived is well known and will not be described here. Clearly many other forms of digital filter are suitable for implementing the filter bank 12.

Figure 3:
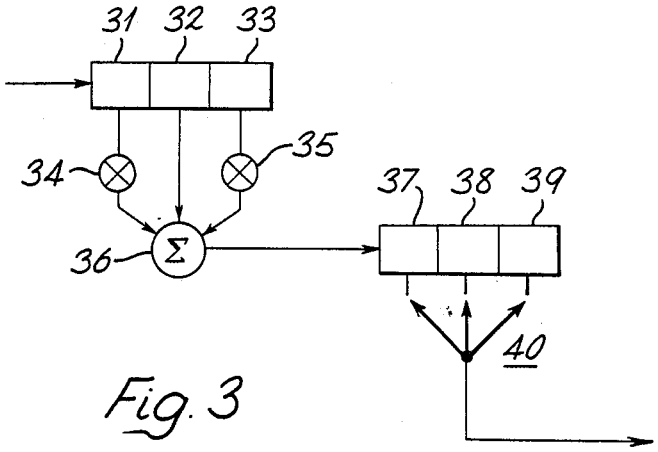
FIG. 3 is a block diagram of the median-filtering and smoothing processes carried out in FIG. 1.

Returning to FIG. 1, a full wave rectification 27 is now carried out in each channel and, for digital signals, comprises taking the modulus value of each sample. An integration 28 follows in which 32 samples are added and the result dumped for use in the next operation. At this stage therefore the sample rate has been reduced to one sample every 3.2 mS. An operation 30 of median filtering and smoothing is now carried out and is shown in more detail in FIG. 3. The current output of the integration 28 and two previous such outputs are stored as shown at 31 to 33, respectively. The samples 31 and 33 are multiplied at 34 and 35 by coefficients of typically 0.7 and the outputs summed at 36. Three successive outputs from the summing 36 are held at 37 to 39 and the highest of these three values is selected at 40 as the output from median filtering and smoothing, so reducing the sampling rate to a quarter and resulting in one sample every 12.8 mS.

In order to modify the channel outputs so that they are more similar to the relative intensities perceived by the human ear, the logarithm, for example to base e, is computed for each new sample in an operation 43 so generating nine outputs $F'_1$ to $F'_9$. Then ten feature vectors $F_0$ to $F_9$ are computed from the nine outputs $F'_1$ to $F'_9$ as follows:

$$F_o = \frac{1}{9} \sum_{n-1}^{9} F_n$$

$$F_n = F_n - F_o$$

The feature vector $F_0$ is the average power over the whole spectrum and can be regarded as the general amplitude of the sound received at that time. Each of the other feature vectors $F_n$ (where n=1 to 9) gives the sound intensity in one of the nine channel bands after modification to allow for the general amplitude of sound at that time.

While a specific embodiment of the invention has been described and some alternatives mentioned, it will be realised that the invention can be put into practice in many other ways.

I claim:

1. Apparatus for speech analysis comprising:

an analogue to digital converter connected to receive a speech signal to be analyzed, filter means coupled to an output of said analogue to digital converter, for filtering said output to provide a plurality of signals, representative of power intensities in a plurality of frequency ranges in the audio frequency band, median-filtering means, coupled to said filter means, for repeatedly processing a group of successive samples in each said frequency range by multiplying the samples in each said group by respective coefficients and summing the resultants, and smoothing means for repeatedly processing a group of successive outputs of the median-filtering means in said each frequency range by selecting one output according to relative magnitudes thereof.

2. Apparatus according to claim 1, further comprising means, receiving outputs of said smoothing means for computing a feature vector wherein one element of the vector is representative of the average power at the outputs of the smoothing means and the other elements of the vector are representative of the outputs of the smoothing means of respective ranges minus the said average output.

3. Apparatus according to claim 1 wherein said filter means includes means for integrating each output in each frequency range before application to the median-filtering means.

4. Apparatus according to claim 1 wherein the outputs of the smoothing means are coupled to respective means for computing the logarithms of the output signals thereof.

5. A method of spectrum analysis comprising the steps of converting an analogue signal, having a spectrum to be investigated, to digital form, filtering the digital signal to provide signals representative of power intensities in a plurality of frequency ranges in said spectrum, repeatedly processing a group of successive samples in each said frequency range by multiplying the samples in each group by a respective coefficient and summing the resultants, and repeatedly processing a group of successive summed resultants in each range by selecting one output according to relative magnitudes.

6. Apparatus according to claim 1 wherein the selection according to relative magnitude is the selection of the highest magnitude output.

7. Apparatus according to claim 1 wherein one or more of the said means are provided by a single integrated circuit.

8. A method according to claim 5 wherein the selection according to relative magnitude is the selection of the highest magnitude output.

* * * * *